US005946819A

United States Patent [19]

Reimer et al.

[11] Patent Number: 5,946,819

[45] Date of Patent: Sep. 7, 1999

[54] CONTINUOUS TEXTILE WEB DRYER

[75] Inventors: Manfred Reimer; Marc-Aurel Voth; Karl-Heinz Gottschalk, all of Hamburg; Hans-O. Jeske, Reppenstedt, all of Germany

[73] Assignee: Babcock Textilmaschinen GmbH, Seevetal, Germany

[21] Appl. No.: 08/973,633

[22] PCT Filed: Jun. 25, 1996

[86] PCT No.: PCT/EP96/02754

§ 371 Date: Nov. 26, 1997

§ 102(e) Date: Nov. 26, 1997

[87] PCT Pub. No.: WO97/03331

PCT Pub. Date: Jan. 30, 1997

[30] Foreign Application Priority Data

Jul. 13, 1995 [DE] Germany ..... 195 25 545

[51] Int. Cl.[6] ..... F26B 21/06

[52] U.S. Cl. ..... 34/541; 34/545; 34/633; 34/643; 34/646; 34/650

[58] Field of Search ..... 34/267, 268, 273, 34/274, 525, 535, 541, 545, 629, 633, 638, 639, 643, 646, 650

[56] References Cited

U.S. PATENT DOCUMENTS

| | | | |
|---|---|---|---|
| 3,641,681 | 2/1972 | Brock | 34/273 |
| 4,197,659 | 4/1980 | Brinkhaus et al. | 34/638 |
| 4,831,747 | 5/1989 | Roos et al. | 34/565 |
| 4,952,145 | 8/1990 | Kwiatkowski et al. | 34/273 X |
| 5,285,582 | 2/1994 | Kouichi et al. | 34/638 |
| 5,333,395 | 8/1994 | Bulcsu | 34/644 X |
| 5,619,808 | 4/1997 | Pabst | 34/644 X |

FOREIGN PATENT DOCUMENTS

| | | |
|---|---|---|
| 81 11 908 U | 8/1981 | Germany . |
| 37 06 615 C2 | 10/1993 | Germany . |

*Primary Examiner*—Henry Bennett
*Assistant Examiner*—Steve Gravini
*Attorney, Agent, or Firm*—Michael J. Striker

[57] ABSTRACT

Tenter driers are frequently used for drying textile webs whose edges have an increased weight per unit area or have been treated with glue. It is extremely difficult to dry the edges to the same degree of residual humidity as the remainder of the web. In the inlet region, the blower box has been replaced by blower pipes extending parallel to the chain rails. The pipes are connected to the recirculated air system of the drier and provided with nozzle apertures directed towards the web edges. Since only a low drying capacity is available, the drier either has to be extended or the throughput speed has to be decreased. With the drier according to the invention, a longitudinal section which starts at the inlet and extends over at least 20% of the total length is equipped with blower pipes (27, 28) aligned parallel to the chain rails (13, 14). Blower boxes (18, 19) are also mounted in this longitudinal section, both above and below the textile web (15). In order to feed drying medium to the blower pipes (27, 28), an additional blower (32) which is connected to a blower box (18) in the inlet region (1) is provided.

17 Claims, 4 Drawing Sheets

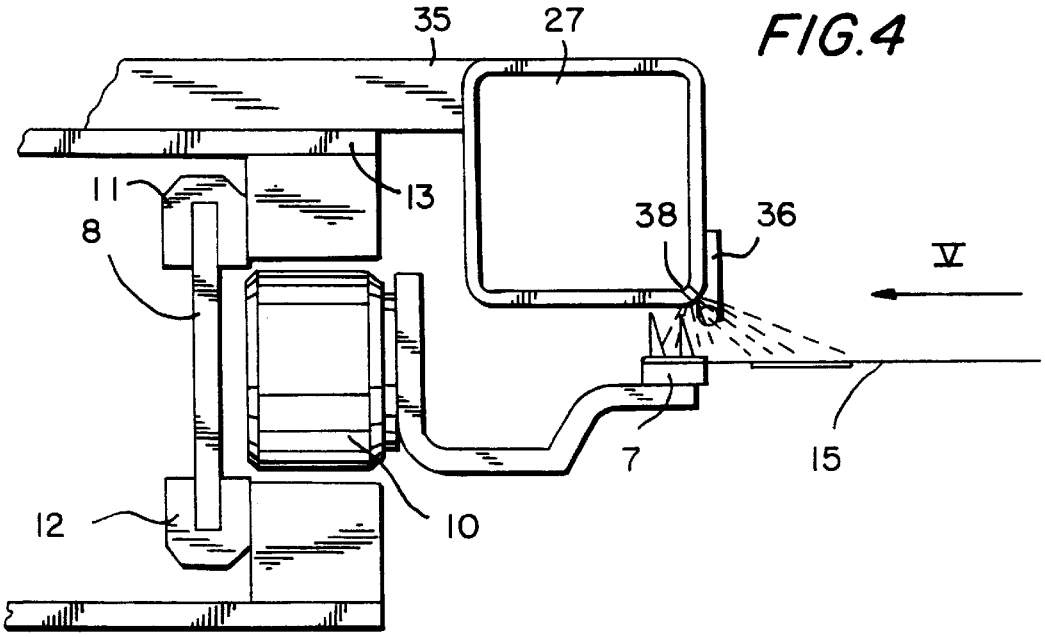
FIG.5
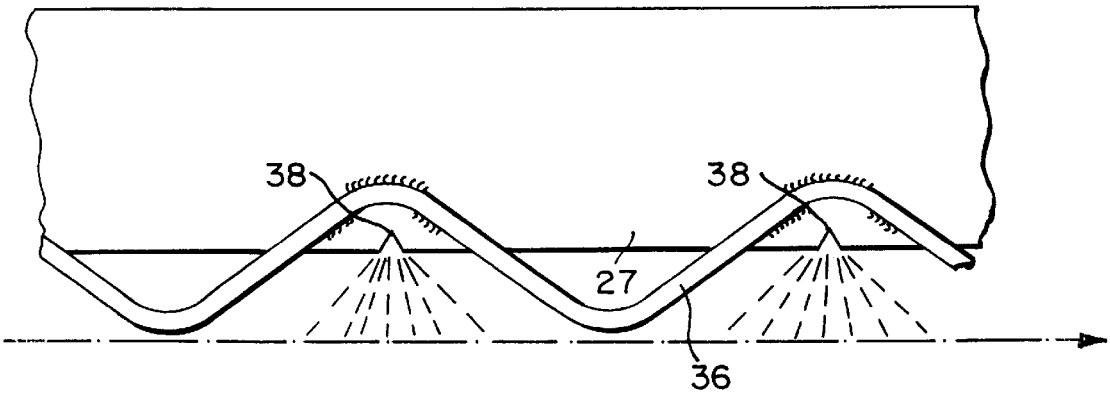

35
27

11
13
8
38
36
7
15
12
10
38
37

CONTINUOUS TEXTILE WEB DRYER

BACKGROUND OF THE INVENTION

The invention relates to a dryer for continuous textile webs.

It is known that difficulties arise in connection with drying of textile webs, if the structure of the web edges diverges from the structure of the remaining web, either because the edges are embodied to be denser and therefore have a greater goods weight, or because the edges had been subjected to a prior sizing. In these cases the edges dry more slowly than the remaining web. In order to assure the drying of the edges, too, the machines then must be run slower. This results in a reduction of the throughput of the goods.

The invention is based on a device which has been described in DE-GM 81 11 908. In this device the blower tubes are seated at the beginning of the inlet area, if required also at the end of the outlet area, of a dryer consisting of several areas. They are provided with nozzle slits, whose blowing direction is aimed toward the web edges. In the longitudinal section in which the blower tubes are arranged, the upper blower boxes for the large surface treatment of the textile webs is missing. This measure is apparently used to provide sufficient space for housing blower tubes of relatively large cross section, as well as for the appropriately feed lines by means of which the blower tubes are connected without additional blowers to the existing circulating air system. Only a reduced drying output is possible in the inlet area because of the missing blower box. Therefore the length of the dryer must be increased accordingly. In order to keep the increase within economically tolerable limits, the longitudinal sections in which the blower tubes have been installed must be kept as short as possible. Because of this, the drying output additionally provided in the edge areas is limited.

With another dryer, which is also described in the mentioned reference, additional devices are provided outside of the actual dryer, namely upstream of the inlet area and downstream of the outlet area. Each additional device comprises an infrared radiator arranged underneath the web edge, and a blower tube arranged above the web edge. A hot air generator in the form of a blower is furthermore a part of each additional device, whose aspirating side is connected with the infrared radiator via a suction line and whose pressure line is connected with the blower tube. A decrease of the drying output of the actual dryer is prevented in this way. But additional space requirements are created upstream and downstream of the dryer. If sufficient drying of the edges is to be achieved, this space requirement is considerable. But it has also been shown that the personnel is subjected to a considerable nuisance because of the smell from such devices arranged outside of the dryer. In case of an unexpected stoppage, infrared radiators can cause damage to the continuous textile web.

A dryer known from DE-PS 37 06 615 is also a part of the prior art. With this dryer, sheet metal guide panels have been disposed on the chain rails, by which the drying medium exiting the blower boxes in the edge zones is intended to be collected and positively directed onto the edges. In this case several such sheet metal guide panels can be lined up on a partial section, not specified in detail, beginning at the dryer inlet. In connection with this dryer it has been shown, that the additional drying output conducted to the edges is relatively weak, so that it is not sufficient in all cases.

SUMMARY OF THE INVENTION

It is therefore the object of the invention to create a dryer, by means of which an effective edge drying is made possible without additional space requirements and without a reduction in the throughput amount.

This object is attained by a drier of continuous textile webs in which a longitudinal section equipped with blower tubes has at least 20% of a total length of the dryer, blower boxes are also disposed of the longitudinal section above as well as below the textile web, and at least one additional blower for the supply of drying medium to the blower tubes at increased pressure is provided.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 4 shows a detail in a greatly enlarged scale.

FIG. 5 represents a portion of the detail in FIG. 4 in a plan view in the direction toward the part V of FIG. 4.

DESCRIPTION OF PREFERRED EMBODIMENTS

Figure 1:
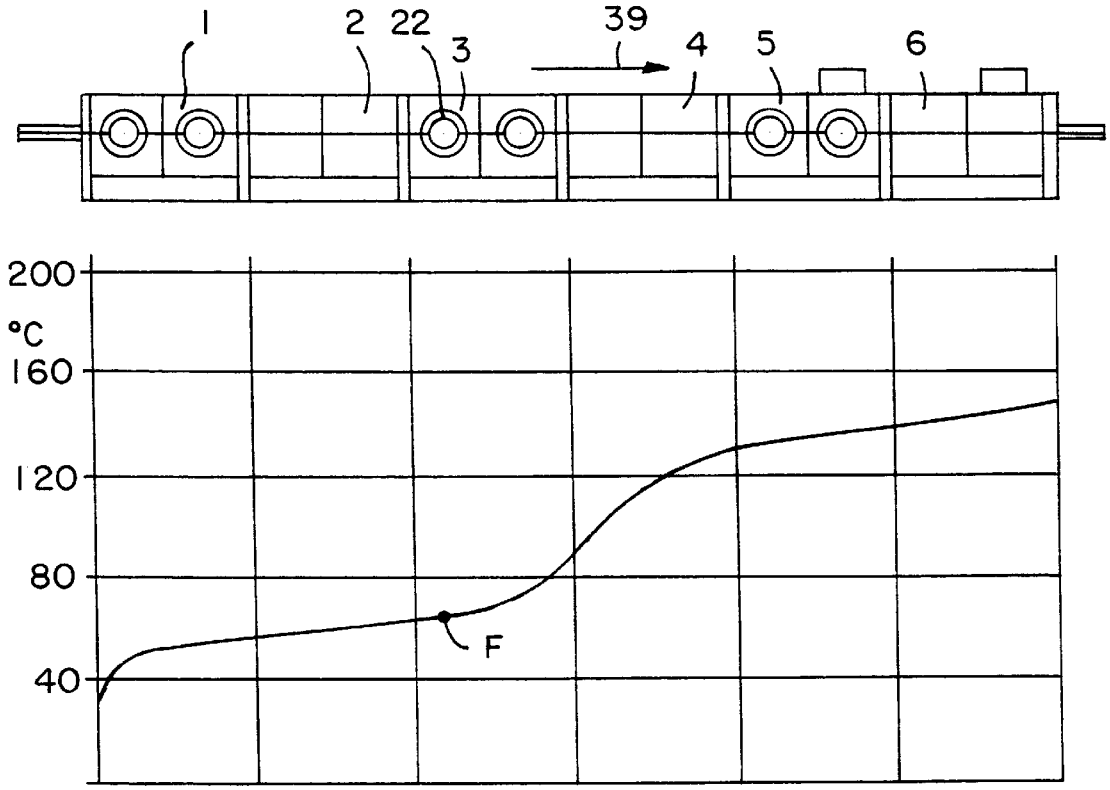
FIG. 1 shows in its upper portion a lateral view of a dryer in accordance with the invention, and in its lower portion the surface temperature during a drying process of a textile web running through its path through the dryer.
Figure 3:
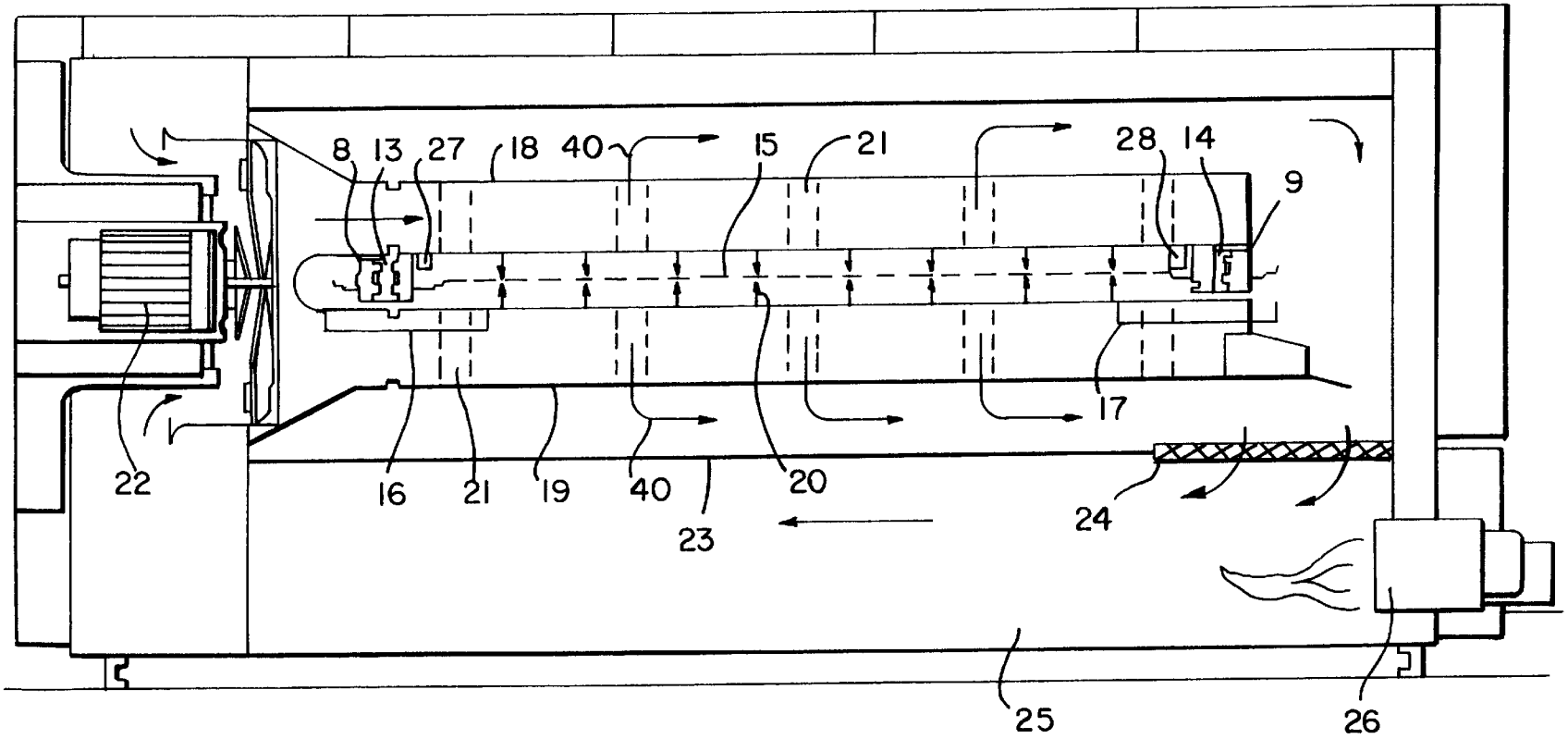
FIG. 3 represents a cross section through the dryer.
Figure 6:
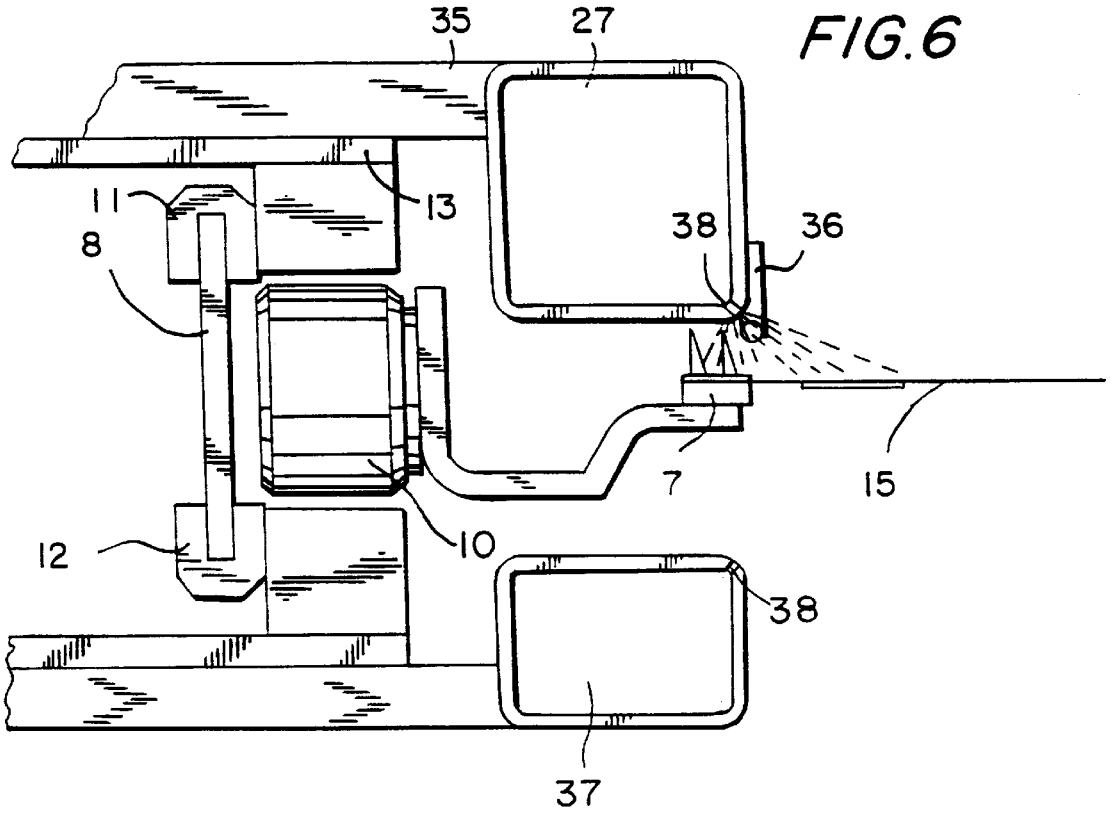
FIG. 6 shows a detail corresponding to FIG. 4 of another exemplary embodiment.

The dryer, schematically represented in FIG. 1, consists of a total of six sections 1 to 6, which have been lined up with each other in a building block-like manner. Endless tension chains 8, 9, equipped with needle bars 7, are conducted in the customary way by rollers 10, 11, 12 on chain rails 13, 14 in the longitudinal direction through the dryer (FIG. 4 and FIG. 6). In this case the chain surface, to which the respectively to be treated textile web is pinned by the needles, runs on the inside of the chain rail 13, 14. With a dryer with a horizontal chain guidance, such as represented in FIG. 3, the returning side runs on the outside of the chain rail 13, 14. With a vertical chain guidance, the returning side lies underneath the forward running side. The two chain rails 13, 14 can be adjusted in the crosswise direction, so that their distance can be matched to the respectively stretched-in textile web 15. The adjusting range includes respectively one edge zone on both sides, as symbolized by a bracket 16, 17 in FIG. 3.

Respectively two blower boxes 18 are disposed above the textile web 15 in the areas 1 to 6, respectively two blower boxes 19 underneath the textile web 15. The lateral edges of the blower boxes 18, 19 cover the two edge zones symbolized by the brackets 16, 17 to a large extent. On the side facing the textile web 15, they are provided with nozzle openings, indicated by arrows 20, for blowing the drying medium. Several return flow conduits 21 pass through each blower box 18, 19 which—compared with the nozzles 20—have a large cross section and extend from the underside to the top.

On the pressure side, each blower box 18, 19 is connected with an axial blower 22, which has been placed into a blower housing located on one longitudinal side of the dryer. In the elected exemplary embodiment, the axial blowers 22 of adjoining areas are arranged on opposite sides, so that they can only be seen in every second area in FIG. 1. However, the blowers can also all be seated on the same side.

A horizontal intermediate floor 23 is located at a distance underneath the lower blower boxes 19. It is provided with an opening on its longitudinal side located opposite the axial blower 22, which is covered by a filter 24. A heating device, for example a burner 26, is seated underneath the filter in the chamber 25 separated by the intermediate floor 23.

So far, the dryer corresponds to the prior art.

Figure 2:
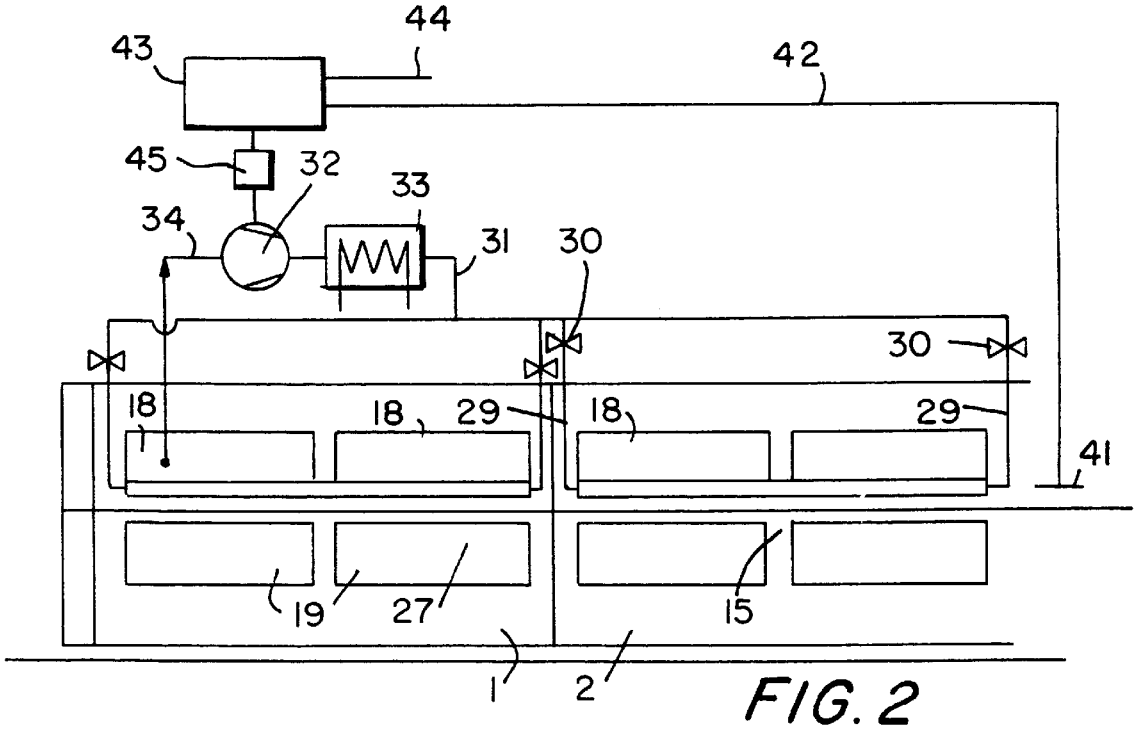
FIG. 2 schematically represents in a larger scale the two first areas of the dryer with the associated blower boxes and blower tubes.

Blower tubes 27, 28 are fastened on the chain rails 13, 14 in the inlet area 1 and the adjoining area 2 and are aligned parallel with the chain rails 13, 14. As shown in FIG. 2, two blower tubes 27 are strung together in the longitudinal section which starts at the inlet of the dryer and extends over the two areas 1, 2 and therefore comprises one third of the dryer represented in FIG. 1, so that the length of an individual blower tube 27 is approximately the size of the length of one field 1, 2. Each blower tube 27, 28 is connected at both ends with branch lines 29, which are respectively provided with a blocking element 30. They emanate from a feed line 31 and are conducted between blower boxes 18 at the joints of adjoining areas 1, 2; 2, 3. The branch line 29 is flexible and can be stretched. It is made from a corrugated hose, for example. The feed line 31 is connected with the pressure side of a blower 32 and is conducted over an auxiliary heating element 33. On the aspirating side, the blower 32 is connected by means of a line 34 to the inlet side of an upper blower box 18 of the inlet field 1.

Appropriate blower tubes can also be arranged in the successive areas 3 to 6, in particular in areas 3 and 4. These additional blower tubes are connected to a separate blower, not represented in the drawings, whose aspirating side preferably is connected with another blower box.

In accordance with FIG. 4, the blower tube 27 has a square cross section. It is fastened by means of holders 35 to the chain rail 13. It projects only slightly upwards past the chain rail 13. At a longitudinal edge located above the needle bar 7, it is provided with a series of round or slit nozzles 38, which are evenly distributed over its length and whose axes are directed on the edge of the pinned-down textile web 15.

A wavily bent wire 36 is welded to the lateral wall facing away from the chain rail 13 as a protection against unpinning in such a way, that the lower bows project downward.

The exemplary embodiment illustrated in FIG. 6 differs from the exemplary embodiment described so far in that a further blower tube 37 with nozzles 38, which are aimed from below on the web edge, is provided underneath the needle bar 7.

In actual operation, the textile web 15 pinned to the needle bar 7 is continuously moved through the dryer in the direction indicated by the arrow 39 by means of the tension chains 8, 9. The distance between the chain rail 13, 14 has been set to correspond to the width of the textile web, taking shrinkage into account. In this case the chain rails 13, 14 with the blower tubes 27, 28 fastened on them are located between the upper blower boxes 18 and the lower blower boxes 19. A hot drying medium is blown on the textile web 15 from above and below by means of the axial blower 22 via the blower boxes 18, 19. The drying medium flowing away from it reaches the conduits located above or below the blower boxes 18, 19 via the return flow conduits 21 and possibly through spaces between the blower boxes 18, 19, as illustrated by arrows 40. From there it flows over the filter 24 and the chamber 25 back to the axial blower 22.

Additional drying medium is blown on the edges of the textile web 15 by means of the blower tubes 27, 28. It is taken from the blower box 18 of the inlet field 1. The aspirated drying medium is placed under increased pressure by means of the blower 32.

By means of this, the pressure loss caused by the narrow cross section of the blower tubes 27, 28, which is kept within limits anyway because of the short length of the individual blower tubes 27, 28, is compensated. The blower streams exiting from the nozzle bores 35 are therefore so strong that the increased drying output required at the edges is achieved. The drying output at the edges can still be further increased by a temperature increase by means of the heating element 33.

In actual use an operation with an increased temperature is performed in the inlet area 1, at least in its first half, in order to heat up the incoming wet and cold textile web. Since the treatment medium for the blower tubes 27, 28 is taken from the inlet area 1, the increased temperature benefits edge drying over the entire longitudinal section equipped with the blower tubes 27, 28 charged by the blower 32. The temperature can be additionally increased by means of the heating element 33, which for the sake of simplicity has been drawn outside of the dryer in FIG. 2, but which in actual use is preferably housed inside the dryer.

The moisture at the edges is automatically kept at the desired level by means of a control circuit symbolically represented in FIG. 2. The control circuit includes a device 41 disposed at the outlet of the dryer on at least one side in the edge area. Preferably one device 41 is respectively assigned to each of the two web edges. The remaining residual moisture at the edge of the textile web leaving the dryer is measured with the device 41. The device 41 generates an appropriate measured signal, which is fed via the lines 42 to a regulator 43. In addition, a command variable is entered via an input 44 into the regulator 43, for example a signal corresponding to the set value of the remaining moisture. The regulator 43 compares the measured signal with the command variable and generates an actuation signal in accordance with the detected difference. In the exemplary embodiment represented in FIG. 2, the actuation signal acts on the drive 45 of the blower 32 to the effect that with the end moisture being too high, the rpm are increased and therefore the intensity of the blower stream directed on the web edge is increased. With too low a end moisture, the rpm of the blower 32 are reduced, so that excessive drying of the edges is prevented.

In place of or in addition to this, the regulator 41 can operate in such a way that, depending on the measured remaining moisture, the blocking elements 30 of the blower tubes 27, 28 in the various areas of the dryer are actuated. If, for example, an end moisture, which approximately corresponds to the set value is measured at one edge, the blower tubes 27, 28 of the areas 1 and 2 are switched on. With the end moisture too high, the blower tubes 27, 28 of the area 3 are also switched on, with the end moisture too low, the blower tubes of the area 2 are switched off.

In case of deviations of the measured end moisture from the set value it is furthermore possible to change the temperature of the additional heating element 33 in such a way that the end moisture approaches the set value. This type of regulation is particularly suited to the suppression of deviations having the same tendency over a longer time. It is advantageous to combine them with a regulation which is suitable for compensating small, short fluctuations, for example a control wherein the regulator 43 acts on the drive 45 of the blower 42.

In a different exemplary embodiment, a further device is arranged at the outlet of the dryer in the area of the center of the web, by means of which the remaining residual moisture outside of the edge areas is measured. An appropriate measured signal is entered as the command variable into the regulator 43 via a transmission track connected with the input 44. With this exemplary embodiment the remaining residual moisture of the web edges is continuously and automatically matched to the remaining residual moisture of the rest of the web.

The dimensions of the longitudinal section which, in the exemplary embodiment described, includes the two areas 1, 2, can be understood by means of the curve in the lower portion of FIG. 1. As shown by the curve, after a heating-up segment extending to approximately the end of the area 2, the surface temperature of the textile web 15 remains essentially constant. It is also clearly below 100° Celsius in the range of the cooling limit temperature and, in a further temperature range, it is almost independent of the temperature of the drying medium. In this portion of the drying segment the moisture adhering to the surface evaporates. In the following area 3 a marked increase in the temperature can be observed which, at the end of the area 4, approximately reaches the temperature of the drying medium. The point F, where the rise starts, is the point at which the water adhering to the surface has evaporated. Therefore in this case the longitudinal section, in which the blower tubes 27, 28 are arranged, extends to approximately this point. In this entire section the web is insensitive to an excess temperature of the drying medium. Therefore, in accordance with the invention this area is used to supply the drying medium to the edges at a high temperature, so that a high evaporation output is achieved.

As can be noted in FIG. 1, the succeeding section in which the temperature rises, extends far into the area 4. It is possible to operate, at least in the first part of this section, at an increased temperature of the drying medium without damage to the material.

The point F depends on the properties of the material and the process parameters. As a rule, the section located in the cooling limit temperature range comprises 20 up to at most 50% of the entire length of the dryer. Therefore the section, in which the web edges are subjected to an increased temperature, may extend over at most 50% of the dryer length. The blocking elements 20 allow an optimal adaptation to individual cases. If further blower tubes for edge drying are arranged in the downstream area of the dryer, they are supplied with a drying medium whose temperature does not exceed the temperature of the drying medium recirculated in the end areas.

We claim:

1. A dryer for continuous textile webs, comprising circulating, guided tension chains provided with holding elements; chain rails displaceable transversely to a running direction of a textile web in an area of edge zones; blower boxes arranged above and below a textile web and at least partially covering the edge zones, said blower boxes extending over a whole width of the textile web and at a side facing the textile web being provided with nozzle openings; additional blower tubes fastened in a longitudinal section starting at a dryer inlet on said chain rails and aligned parallel with them, said additional blower tubes being provided with nozzle openings whose blow direction interaction is aimed on edges of the textile web, said longitudinal section equipped with said blower tubes extending over at least 20% of a total length of the dryer, said blower boxes being also disposed in said longitudinal section above and below the textile web; and at least one additional blower provided for a supply of dry medium to said blower tubes at increased pressure.

2. A dryer as defined in claim 1, wherein said chains are horizontally guided.

3. A dryer as defined in claim 1, wherein said chains are vertically guided.

4. A dryer as defined in claim 1, wherein said holding elements are formed as needle parts.

5. A dryer as defined in claim 1, wherein said holding elements are formed as tensioning clips.

6. A dryer as defined in claim 1; and further comprising a blower which is connected on an aspirating side with one of said blower boxes disposed in an immediate vicinity of the dryer inlet; and a feed line which connects said blower tubes of a partial section extending at most over 50% of the length of the dryer with a pressure side of said blower.

7. A dryer as defined in claim 1; and further comprising an additional heater and a feed line which is conducted over said additional heater and connects said blower tubes of a partial section extending at most over 50% of the dryer.

8. A dryer as defined in claim 1, wherein said blower tubes are located above said holding elements.

9. A dryer as defined in claim 1, wherein said blower tubes are located under said holding elements.

10. A dryer as defined in claim 1, wherein said blower tubes are strung together in a longitudinal direction.

11. A dryer as defined in claim 1; and further comprising lines conducted to said blower tubes and provided with blocking elements.

12. A dryer as defined in claim 1; and further comprising an unpinning protection device fastened on said blower tube.

13. A dryer as defined in claim 1; and further comprising at least one device arranged at an outlet of the dryer in an area of a web edge for measuring a remaining moisture and for generating an appropriate measured signal; and a regulator which compares the measured signal with a command variable, generates an actuation signal in accordance with a detected difference, and acts in the sense of reducing the difference.

14. A dryer as defined in claim 13, wherein said regulator acts on actuating members of said blower.

15. A dryer as defined in claim 13, wherein said regulator acts on an additional heating element.

16. A dryer as defined in claim 13, wherein said regulator acts on blocking elements.

17. A dryer as defined in claim 1; and further comprising a device disposed in an area of a web center for measuring a remaining residual moisture and for generating a corresponding measured signal; a transmission track for entering the measured signal as a command variable; and a regulator in which the command variable is entered.

* * * * *